US008858290B2

(12) United States Patent
Clark et al.

(10) Patent No.: US 8,858,290 B2
(45) Date of Patent: Oct. 14, 2014

(54) PUSH TOY WITH AMUSEMENT FEATURES

(75) Inventors: Jacob J. Clark, East Aurora, NY (US); Michael Armbruster, Grand Island, NY (US)

(73) Assignee: Mattel, Inc., El Segundo, CA (US)

( * ) Notice: Subject to any disclaimer, the term of this patent is extended or adjusted under 35 U.S.C. 154(b) by 159 days.

(21) Appl. No.: 13/476,408

(22) Filed: May 21, 2012

(65) Prior Publication Data

US 2013/0309936 A1 Nov. 21, 2013

(51) Int. Cl.
*A63H 1/00* (2006.01)
*A63H 33/00* (2006.01)

(52) U.S. Cl.
CPC ..... *A63H 33/007* (2013.01)
USPC ..... 446/238

(58) Field of Classification Search
USPC ..... 446/73, 75, 237, 424, 427, 435, 465, 446/238, 426
See application file for complete search history.

(56) References Cited

U.S. PATENT DOCUMENTS

| | | | | |
|---|---|---|---|---|
| 2,578,579 | A | 12/1951 | Mysels | |
| D182,791 | S | 5/1958 | Crawford | |
| 2,835,074 | A | 5/1958 | Crawford et al. | |
| 2,937,475 | A | 5/1960 | Crawford | |
| 2,976,645 | A | 3/1961 | Hight et al. | |
| 3,049,833 | A | 8/1962 | Felsch | |
| 3,197,918 | A * | 8/1965 | Coggeshall | 446/290 |
| 3,240,201 | A * | 3/1966 | Shelton | 124/17 |
| 3,264,782 | A | 8/1966 | Glass et al. | |
| 3,959,922 | A * | 6/1976 | Leistikow | 446/144 |
| 3,983,662 | A * | 10/1976 | Hart | 446/237 |
| 4,031,659 | A * | 6/1977 | Keller et al. | 446/427 |
| 4,140,325 | A * | 2/1979 | Tucker et al. | 280/1.14 |
| 4,198,068 | A | 4/1980 | Goldfarb et al. | |
| 4,262,443 | A * | 4/1981 | Ferris et al. | 446/289 |
| 4,430,827 | A * | 2/1984 | Rice et al. | 446/465 |
| D272,927 | S | 3/1984 | Dropik | |
| 4,693,697 | A | 9/1987 | Pagano | |
| D302,186 | S | 7/1989 | Klawitter | |
| 5,238,440 | A | 8/1993 | Morin | |
| D349,309 | S | 8/1994 | Thornell | |
| 5,335,917 | A | 8/1994 | Kuna | |
| 5,378,191 | A * | 1/1995 | Ryaa | 446/424 |
| D367,083 | S | 2/1996 | Suknaic | |
| 5,588,939 | A | 12/1996 | Zheng | |
| D505,979 | S | 6/2005 | Pokorny | |
| 7,143,461 | B2 * | 12/2006 | Spooner | 15/41.1 |

* cited by examiner

*Primary Examiner* — Kurt Fernstrom
(74) *Attorney, Agent, or Firm* — Edell, Shapiro & Finnan, LLC

(57) ABSTRACT

A push toy includes a collecting mechanism and a stirring mechanism in order to enhance the play value. The push toy is comprised of a handle, a housing, and a wheel assembly such that a user may roll the push toy along a support surface. The push toy may collect objects, such as toy balls, store the objects within the housing, and subsequently release or expel the objects so they may be collected again.

19 Claims, 4 Drawing Sheets

PUSH TOY WITH AMUSEMENT FEATURES

FIELD OF THE INVENTION

The present invention relates to a push toy with amusement features, and in particular, a children's toy for receiving and manipulating toy objects, such as toy balls.

BACKGROUND OF THE INVENTION

Various children toys which interact with toy objects, such as toy balls, are known. Some designs allow the user to pick up or otherwise receive a toy ball, but simply store the ball once it is picked up by the toy. Other toys may manipulate toy balls stored within the toy, such as by expelling the balls from the toy or shaking the balls or objects stored therein. However, these toys only provide one play feature and it is desirable to enhance the play experience with multiple play features.

SUMMARY OF THE INVENTION

The present invention is directed to a push toy, or more specifically, a children's push toy with multiple amusement or play features. The toy may allow a child to collect, manipulate, carry and store toy objects, such as balls. Notably, the toy may allow a child to collect or gather toy objects and may spin or manipulate the objects once they are gathered, sometimes displacing the objects from the toy so that the child may gather the toy objects again.

In one embodiment a child's push toy includes a housing having an open top, a bottom, a front portion, and a back portion. The front portion may include an opening formed therein and the housing can define an interior region. The child's push toy further includes at least one wheel rotatably attached to the housing, a collecting mechanism and a stifling mechanism. The collecting mechanism includes at least one arm pivotally coupled to the housing proximate the opening in the front portion, the at least one arm being configured to direct an object outside of the housing through the opening and into the interior region. The stifling mechanism may be rotatably attached within the housing and configured to rotate within the interior region in order to cause objects to move within the housing while having intermittent contact with the stirring mechanism, out of the housing through the open top, or some combination thereof.

In another embodiment the push toy may include a handle extending from the back portion of the housing. The handle includes a chute configured to receive objects and direct the objects into the interior region of the housing.

The still another embodiment, the push toy includes a collecting mechanism with at least one arm, wherein the arm includes a paddle to facilitate the gathering of objects into the housing. Likewise, in some embodiments, the stirring mechanism includes a rotating disk and a plurality of paddles disposed on the rotating disk.

In some embodiments, rotation of the at least one wheel may rotate the collecting mechanism, the stirring mechanism, or some combination thereof. For example, in some embodiments, the collecting mechanism pivots the at least one arm when the at least one wheel is rotated. In other embodiments, the stirring mechanism rotates within the interior region when the at least one wheel is rotated.

In yet another embodiment, a child's push toy includes a container defining a cavity and having a top, a bottom, a front, and a back, the top defining a first opening configured to allow an object in the cavity to exit therethrough, the front defining a second opening configured to allow an object outside of the container to move into the cavity of the container. The push toy also includes a handle extending from the container and a stirring mechanism rotatably mounted within the cavity of the container. The stirring mechanism is configured to rotate within the cavity of the container and engage an object therein.

In another embodiment the push toy may include a gathering mechanism operatively connected to the front of the container, the gathering mechanism being configured to direct an object outside of the container through the second opening and into the cavity.

In other embodiments, the push toy may include a speaker, and the speaker may be configured to produce audio output in response to actuation. In some embodiments, the speaker is configured to be actuated by rotation of the stirring mechanism.

In still another embodiment, a child's push toy includes a housing with an upper compartment, a lower compartment and a passageway extending therebetween. The upper compartment includes an outer wall and an inner wall, wherein the inner wall and outer wall are coupled at a top edge and the inner wall defines an interior cavity. The lower compartment is attached to the upper compartment and has a top, bottom, front wall and back wall, wherein the front wall includes an opening for receiving objects therethrough. The passageway is formed between the upper compartment and the lower compartment and configured to allow an object to move between the lower compartment and the upper compartment. The toy of this embodiment also includes a collecting mechanism and a stirring mechanism. The collecting mechanism includes at least one arm pivotally coupled to the housing proximate the lower compartment, wherein the at least one arm is configured to direct an object outside of the housing through the passageway and into the interior cavity. The stirring mechanism is rotatably attached within the upper compartment and configured to rotate within the interior cavity, such that movement of the stirring mechanism causes objects to move.

In another embodiment, the push toy also includes at least one wheel and an axle, wherein the at least one wheel is mounted on the axle, and the axle is rotatably attached to the container. In some of these embodiments, the axle is configured to drive the stirring mechanism, while in other embodiments, the axle is configured to drive the collecting mechanism.

In some embodiments, the push toy may also include guide members coupled to the front wall and configured to direct objects toward the collecting mechanism. Further, in other embodiments, the passageway of the push toy is configured to allow the at least one arm to rotate through both the upper compartment and the lower compartment.

BRIEF DESCRIPTION OF THE DRAWINGS

Like reference numerals have been used to identify like elements throughout this disclosure.

DETAILED DESCRIPTION OF THE INVENTION

Figure 1:
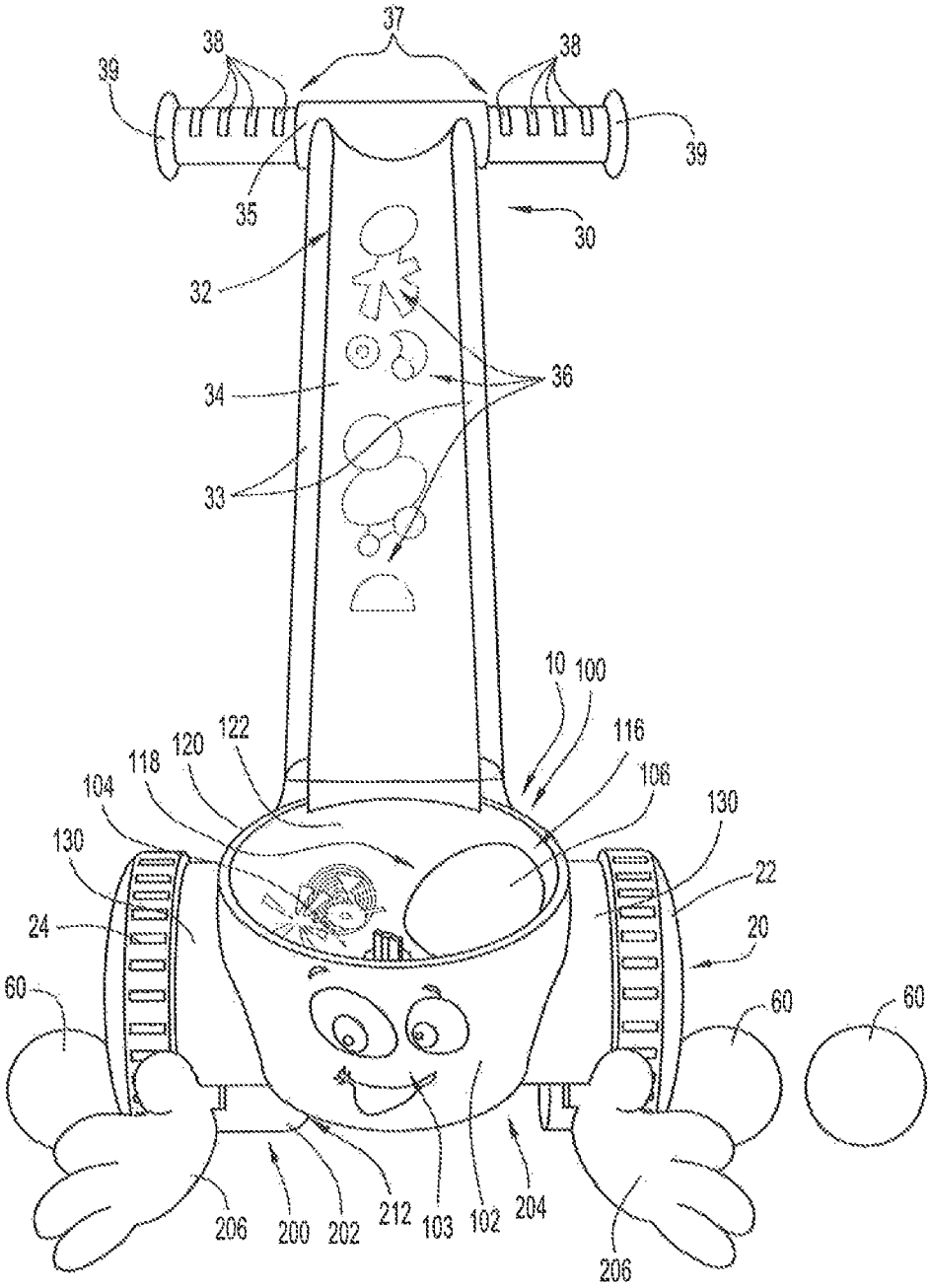
FIG. 1 illustrates an elevated front perspective of an embodiment of a product according to the present invention.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as may be described herein, and do not limit the present invention to any particular configuration or orientation. Further, the term "exemplary" is used herein to describe an example or illustration. Any embodiment described herein as exemplary is not to be construed as a preferred or advantageous embodiment, but rather as one example or illustration of a possible embodiment of the invention.

Generally referring to FIGS. 1-6, an embodiment of a push toy which may receive and manipulate toy objects is shown. In this embodiment, the toy includes a housing 10, a wheel assembly 20, a handle 30, and at least one object manipulation device, such as a collecting mechanism 40, a stirring mechanism 50, or some combination thereof. In one exemplary embodiment, as depicted in FIGS. 1-6, housing 10 may include upper compartment 100 and lower compartment 200, which may be coupled together in any desirable manner. In one exemplary embodiment, lower compartment 200 may include openings or receiving cavities, such that housing 10 may collect, scoop, or otherwise receive objects 60, such as toy balls, while upper compartment 100 may include an interior region or cavity which may receive and store any collected or received objects 60. While disposed in upper compartment 100, objects 60 may be mixed, stirred, or otherwise manipulated in order to provide further entertainment and play value.

Figure 2:
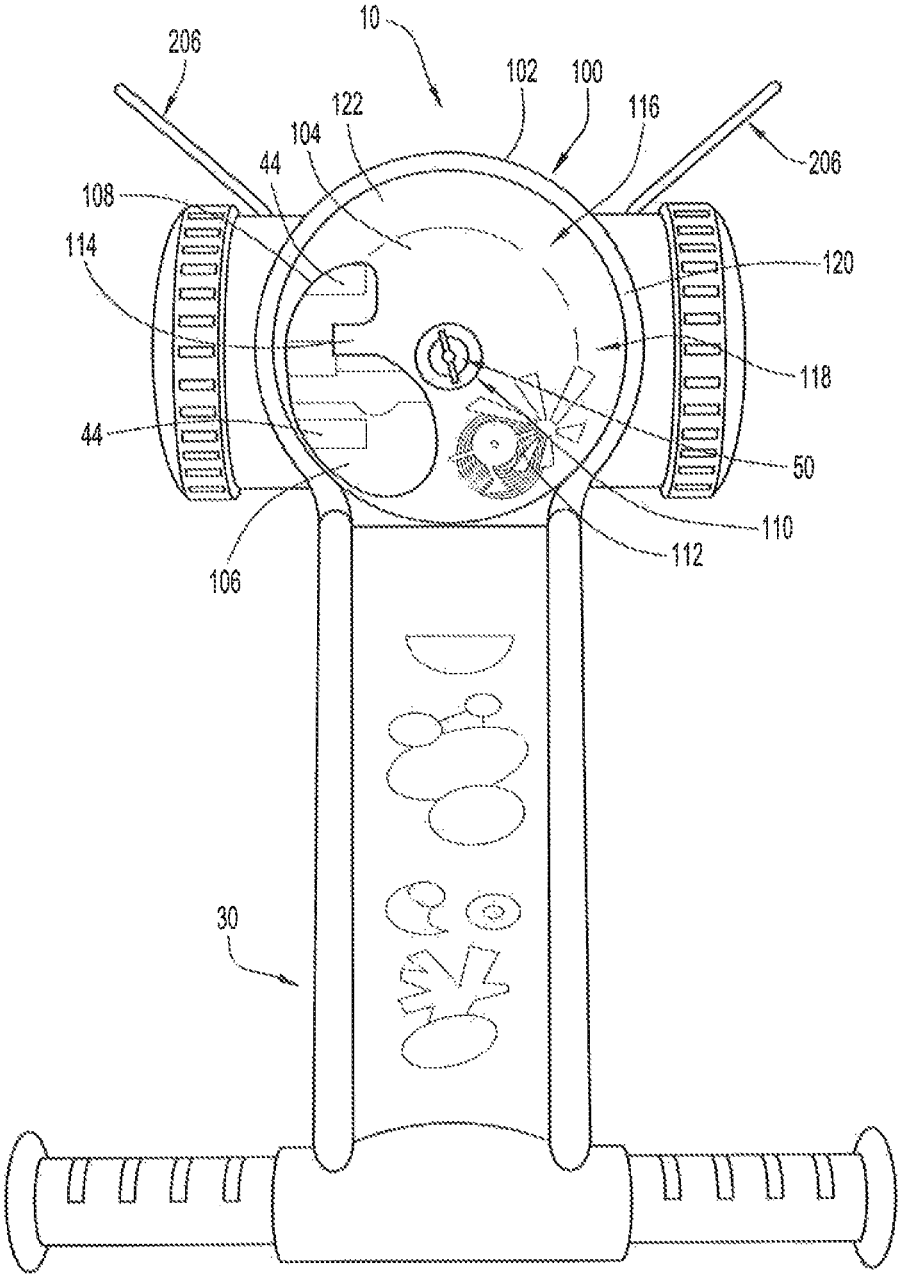
FIG. 2 illustrates a top perspective view of a product, including a housing and a handle according to an embodiment of the present invention.

Now referring to FIG. 1, in one exemplary embodiment, handle 30 may be coupled to housing 10, which may, in turn, be coupled to wheel assembly 20 in order to form a push toy. Handle 30 may include elongate member 32 and grip portion 37. Elongate member 32 may have a first end coupled to grip portion 37, a second end coupled to housing 10, and may include a chute 34 which may be defined by ridges 33. In some exemplary embodiments, and as depicted in FIGS. 1-2, ridges 33 may be formed as cylindrical or semi-cylindrical raised portions of elongate member 32 disposed on first and second opposing edges of elongate member 32. In this manner, ridges 33 may define chute 34, such that chute 34 may receive objects 60 and may direct objects 60 towards the second end of elongate member 32. Ridges 33 may be formed integrally with elongate member 32 or, alternatively, ridges 33 may be formed separately and coupled to elongate member 32. Indicia 36 may also be included on chute 34 in order to provide additional play value. Additionally, elongate member may include a top member 35 at its first end in order to facilitate coupling of elongate member 32 to grip portion 37.

Grip portion 37 may be coupled to elongate member 32 in any desirable manner. For example, in some exemplary embodiments, grip portion 37 may include one cylindrical member extending through elongate member 32 and coupled to elongate member 32 at a center portion of the cylindrical member. Alternatively, in other exemplary embodiments, and as depicted in FIGS. 1-2, grip portion 37 may include two cylindrical members, each coupled to opposing sides of elongate member 32 and extending outwards therefrom. Additionally, grip portion 37 may be movably coupled to elongate member 32 such that grip portion 37 may be extendable, rotatable, collapsible or otherwise articulable in relation to top member 35. For example, grip portion 37 may collapse within top member 35 in order to decrease the width of handle 30 for storage. Grip portion 37 may include recesses 38 forming grips along its length and may also include bulbous portions 39 disposed at the distal ends of grip portions 37 in order to further facilitate gripping of handle 30.

With continued reference to FIG. 1, housing 10 may be coupled to handle 30 and may include an upper compartment 100 and a lower compartment 200. Upper compartment 100 and lower compartment 200 may be coupled together in any desirable manner and may allow housing 10 to receive objects 60 from handle 30 or a surface over which the push toy is traveling. With particular reference to upper compartment 100, upper compartment 100 may include an outer wall 102, which may be substantially circular. Outer wall 102 may be formed with or coupled to a support member 130, which may be an arcuate shaped member formed around an axis substantially perpendicular to the central axis of outer wall 102. In one embodiment, support member 130 may have dimensions substantially similar to a top portion of wheels 22 and 24, such that upper compartment 100 appears to be flush with wheels 22 and 24. Moreover, indicia, such as indicia 103, may be included on any of the surfaces of upper compartment 100. For example, in the embodiment depicted in FIG. 1, the front portion of outer wall 102 may contain indicia 103 in the form of a smiley face.

As can be seen in the exemplary embodiments depicted in FIGS. 1-2, outer wall 102 may, together with bottom 104 and top opening 116, define an interior region or cavity 118 with an inner wall 122. In some exemplary embodiments, such as those depicted in FIGS. 1-2, inner wall 122 may be spaced apart from outer wall 102 and, thus, interior cavity 118 may include top edge 120. The inner wall 122 of interior cavity 118 may be partially tapered or sloped, such that interior cavity 118 may be substantially bowl shaped. However, bottom 104 may, in some embodiments, be substantially flat. Additionally, bottom 104 may include various holes and openings, such as object receiving opening 106, paddle receiving opening 108, rotating member opening 110 and speaker openings 112. Openings 106, 108, 110, and 112 may be through openings, cavities, or recesses as desired.

As seen in FIGS. 1-2, in one particular embodiment, openings 106, 108, 110, and 112 may provide a passageway or recess for various objects to pass through or be placed in. For example, and as depicted in FIG. 2, opening 106 may be a passageway which allows objects 60 to move or pass from lower compartment 200 to upper compartment 100, or vice versa, as desired. Opening 106 may also, in conjunction with opening 108, allow paddles 44 to rotate through a full 360 degree rotation such that objects 60 may be moved between compartments 100 and 200. For example, paddles 44 may move objects 60 between a ground surface and interior cavity 118, either raising or lowering the objects 60. In some embodiments, opening 108 may be formed integrally with opening 106. However, opening 108 may be substantially smaller than opening 106, such that, in some embodiments, a paddle 44 may pass through opening 108 while an object 60 may be prevented from doing the same. In one exemplary embodiment, bottom 104 may include an extension or flange 114 which may divide or partially separate opening 106 from opening 108. Openings 110 receive rotating member 50.

Figure 3:
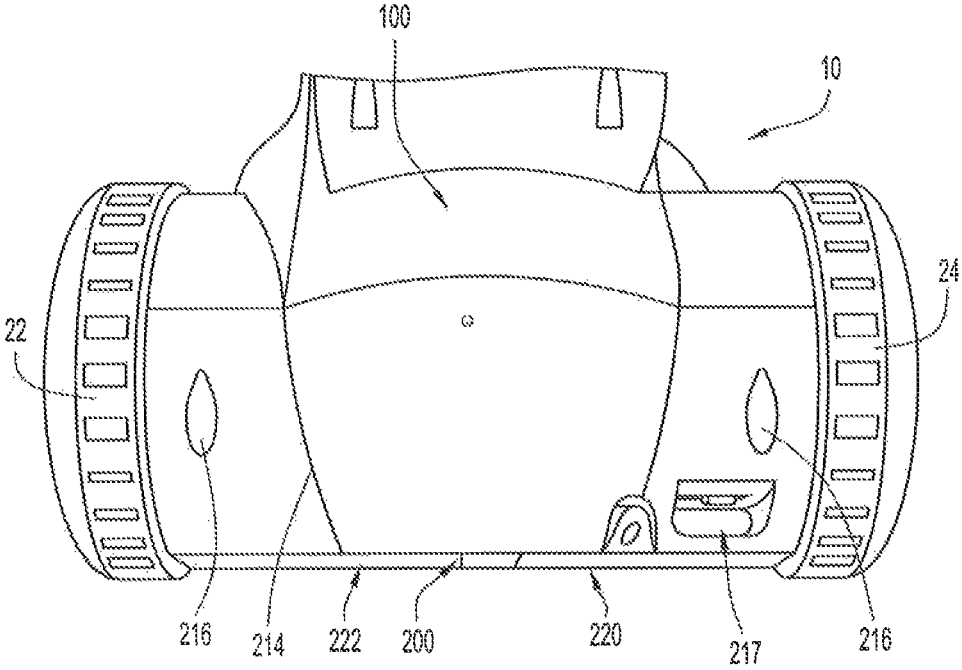
FIG. 3 illustrates an elevated rear perspective view of the housing according to an embodiment of the present invention.
Figure 4:
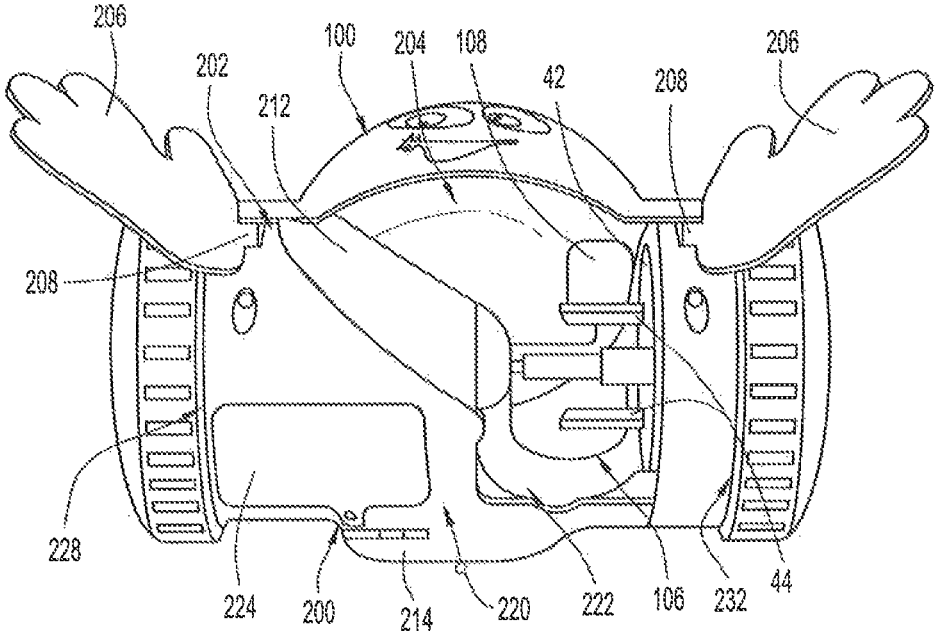
FIG. 4 illustrates a front perspective view, as viewed from a lower disposition, of the housing of FIG. 3.
Figure 5:
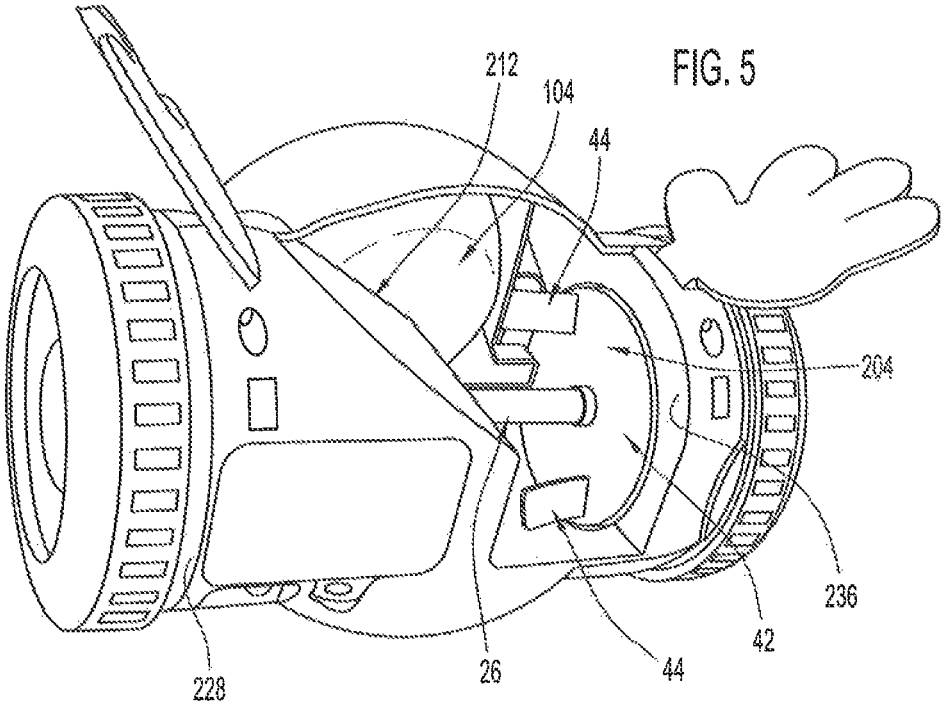
FIG. 5 illustrates an isometric perspective view of the housing of FIG. 3.

Now referring to FIG. 3-5, lower compartment 200 may be shown. Lower compartment 200 may include a front wall 202 and a back wall 214 substantially spaced apart and a bottom wall 220 extending therebetween, such that walls 202, 214, and 220 may appear to form a complete cylinder when coupled with support member 130. In other words, support member 130 and walls 202, 214, and 220 may all be arcuate portions of the same cylinder. However, in some embodiments, such as those depicted in FIGS. 3-5, bottom wall 220 may be substantially flat, such that support member 130, front wall 202 and back wall 214 do not form a complete cylinder. Lower compartment 200 may also include a top wall 218 and first and second side walls 228 and 232. Top wall 218 may extend between the top ends of front and back walls 202 and 214, while side walls 228 and 232 may be disposed at opposite ends of lower compartment 200 and extend substantially between walls 202, 214, 218 and 220. The first and second side walls 228 and 232 may include openings to receive axle 26 (see FIG. 5), as is known in the art.

Referring to FIG. 3, housing 10 is shown from a rear perspective. In the depicted exemplary embodiment, lower compartment 200 and upper compartment 100 are shown coupled together. Back wall 214 may include fastener holes 216, such that fasteners may extend through lower compartment 200 and be received in similar openings or holes (not pictured) included in upper compartment 100 in order to couple compartments 100 and 200 together in accordance with methods known in the art.

Still referring to FIG. 3, back wall 214 may also include switch 217 which may activate any electronic circuits included in the toy. For example, switch 217 may activate a speaker in order to generate audio outputs, such as user recordings or songs, during use of the toy in order to enhance the play experience. In one exemplary embodiment, an audio circuit or sequence may be actuated in response to rotation or articulation of wheel assembly 20. More specifically, if switch 217 is in an on position, a certain number of rotations of axle 26 may actuate or otherwise trigger the output of audio in accordance with methods known in the art. If switch 217 is in an off position, the toy may remain silent regardless of the articulation of axle 26.

Now referring to FIGS. 3 and 4, bottom wall 220 may include collecting opening 222. Opening 222 may be substantially square, however, in other exemplary embodiments, opening 222 may be any desirable shape or size which allows paddles 44 to complete a full rotation around disk 42. Thus, opening 222 may allow paddles 44 to interact with any objects 60 resting on the surface which the toy is traveling over. For example, paddles 44 may sweep or collect objects 60 as paddle 44 rotates towards upper compartment 100. In the exemplary embodiment depicted in FIGS. 3-5, paddles 44 may rotate in a clockwise direction, as viewed from the interior of housing 10, such that paddles 44 may sweep objects 60 backwards into opening 222 and then upwards towards object receiving opening 106 in order to move objects 60 into interior cavity 118. Alternatively, paddles 44 may expel objects 60, such as objects 60 which have fallen into opening 106, from housing 10 by moving objects 60 from upper compartment 100 to lower compartment 200 and then externally of housing 10.

Similar to opening 222; FIGS. 4 and 5 illustrate the inclusion of object collecting opening 204 in front wall 202. Opening 204 is disposed substantially adjacent to second wall 232, but in some embodiments, opening 204 may span over a substantial portion of front wall 202 in order to maximize the area in which housing 10 can collect objects 60 from a supporting surface which the push toy is traveling over. Like opening 222, opening 204 may be any desirable shape which allows panels 44 to rotate in a complete circle, but unlike opening 222, opening 204 must also be large enough to allow objects 60 to pass through. Further, opening 204 may be disposed such that it meets or provides access to openings 106 and 108 in order to allow objects 60 passing into opening 204 to subsequently pass through opening 106. For example, opening 204 may be disposed substantially adjacent to first wall 228 such that it is aligned with openings 106 and 108.

In order to facilitate the passage of objects 60 into opening 204, guide members 206 and tapered edge 212 may also be included in front wall 202, as illustrated in the exemplary embodiments of FIGS. 4 and 5. Guide members 206 extend outwardly from front wall 202 and may be any desirable shape and size, such as simulated hands as depicted in FIGS. 1, 2, 4 and 5. Further, guide members 206 may extend outwards at any desirable angle, such as an obtuse angle from the central portion of front wall 202, so that guide members 206 may direct any encountered objects 60 towards opening 204. Guide members 206 may include ends 208 which may be inserted into front wall 202 and may be secured with fasteners or couplers (not shown). Front wall 202 may also include a tapered or sloped edge 212 in order to further facilitate the passage of objects 60 into opening 204. Tapered edge 212 may have any desirable slope and any desirable shape such that it may direct encountered objects towards opening 204.

Now referring to FIG. 4, bottom wall 214 may include battery compartment 224. The compartment may receive and secure any desirable power source, such as batteries, for any electrical systems included in the toy, such as a speaker.

Figure 6:
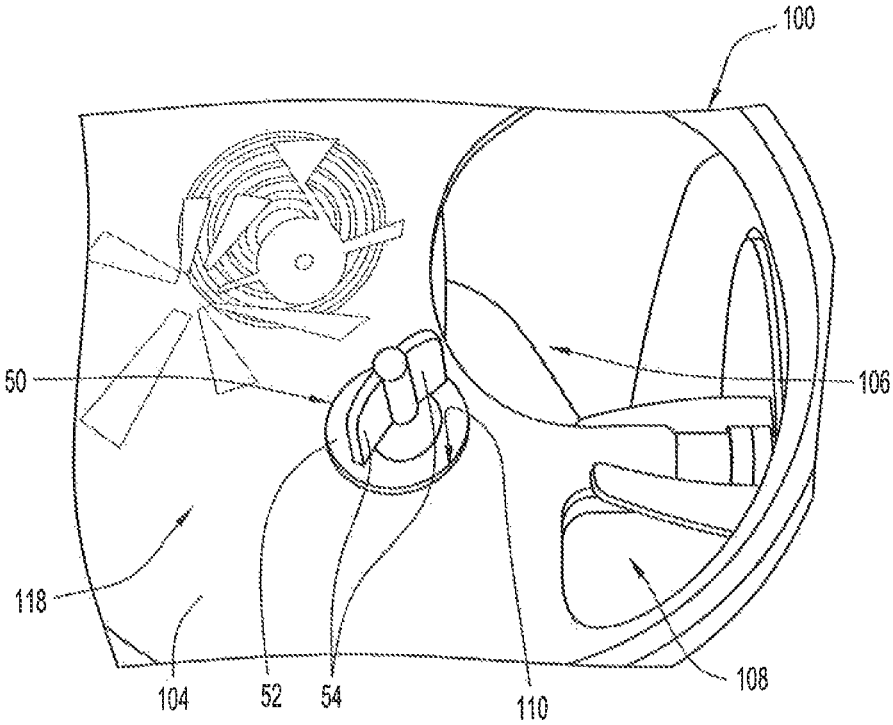
FIG. 6 illustrates a top perspective view of the top of the housing of FIG. 3.

As illustrated in FIGS. 5 and 6, the push toy may include collecting mechanism 40. Collecting mechanism 40 may include disk 42 and paddles 44. More specifically, in one exemplary embodiment, two paddles 44 may be coupled to disk 42 such that they extend outwardly from disk 42 in a substantially radial configuration. In such a configuration, paddles 44 may share an outer edge with disk 42 and have an inner edge substantially closer to the center of disk 42, disposed at any desirable distance from the center. Paddles 44 may be aligned such that when disposed at the top and bottom of disk 42, paddles 44 are disposed in a substantially vertical configuration and when disposed at the right and left sides of disk 42, paddles 44 are configured in a substantially horizontal configuration. However, any desirable configuration which may allow paddles 44 to engage objects 60 may be implemented.

Still referring to FIGS. 5 and 6, disk 42 may be mounted on axle 26 in such a manner that paddles 44 may rotate about, or in unison with, axle 26. For example, in some exemplary embodiments, disk 42 may be fixedly mounted on axle 26 so that when wheels 22 and 24 are subject to frictional forces during forward or rearward movement of the toy, the friction causes the rotation of both axle 26 and disk 42. Axle 26 may be fixedly coupled to wheels 22 and 24 in order to ensure that it rotates in unison with wheels 22 and 24 and, similarly, disk 42 may be fixedly coupled to axle 26 to ensure that disk 42 rotates in unison with axle 26. Thus, forward and rearward movement of the push toy may, in turn, cause paddles 44 to rotate which may facilitate the movement of objects 60 between a ground surface and interior cavity 118.

Referring now to FIG. 6, interior cavity 118 may receive and store objects 60. Objects 60 may be received from chute 34, collecting mechanism 40, or any other desirable manner, but once an object has been received in interior cavity 118, it may be manipulated by stirring mechanism 50. Stirring mechanism 50 may include a rotating disk 52 with arms 54 extending from a central portion thereof. Arms 54 may be of any desirable shape and size and may be fixed to disk 52 such that arms 54 rotate in unison with disk 52. Disk 52 may rotate or spin about its central axis in response to rotation of axle 26. For example, a gear, or series of gears, may be included within housing 10 in order to cause the rotation of stirring mechanism 50 at any desired frequency, such as in unison with the rotation of axle 26. When stirring mechanism 50 is rotated or otherwise actuated, it may cause objects 60 to move, spin, rotate around or even exit interior cavity 118. Such movement may enhance the play value of the push toy. In fact, if objects 60 are expelled from interior cavity 118, a user may be excited to have new objects 60 to collect, thus automatically creating a new play environment.

In operation, wheel assembly 20 allows the entire toy to be moved atop of a support surface. Thus, a child may push the push toy at handle 30 such that housing 10 may be directed towards or over objects 60. Collecting mechanism 40 may collect or gather objects 60, whereupon objects 60 may be retained within housing 10. As a user continues to use the push toy, collecting mechanism 40 and stirring mechanism 50 may periodically expel objects 60 from housing 10 such that a child may continuously collect objects 60. Stirring mechanism 50, in addition with a speaker, may also enhance the play experience by providing additional visual and audio entertainment features during use. Additionally, if a user is unable to collect an object 60 with collecting mechanism 40, a user may simply pick up the object 60 and place it on chute 34 so that it may slide into housing 10 and be stored or manipulated therein.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the claims be construed broadly and in a manner consistent with the scope of the disclosure as set forth in the following claims.

What is claimed is:

1. A child's push toy, comprising:

a housing having an open top, a bottom, a front portion, and a back portion, the front portion including an opening formed therein, the housing defining an interior region; at least one wheel rotatably attached to the housing; a collecting mechanism comprising at least one arm pivotally paddle rotatably coupled to the housing proximate the opening in the front portion, the at least one arm paddle being configured to direct an object outside of the housing through the opening and into the interior region; and a stirring mechanism rotatably attached within the housing, the stirring mechanism being configured to rotate within the interior region, the interior region being configured to receive and store objects, and movement of the stirring mechanism causing the objects to move within the housing while having intermittent contact with the stirring mechanism and, thereafter, out of the housing through the open top.

2. The push toy of claim 1, further comprising:

a handle extending from the back portion of the housing, the handle comprising a chute configured to receive objects and direct the objects into the interior region of the housing.

3. The push toy of claim 1, wherein the collecting mechanism further comprises:

a guide member to facilitate the gathering of objects into the housing.

4. The push toy of claim 1, wherein the stirring mechanism further comprises a rotating disk and a plurality of arms disposed on the rotating disk.

5. The push toy of claim 1, wherein the collecting mechanism rotates the at least one paddle when the at least one wheel is rotated.

6. The push toy of claim 5, wherein the stirring mechanism rotates within the interior region when the at least one wheel is rotated.

7. A child's push toy, comprising:

a container defining a cavity and having a top, a bottom, a front, and a back, the top defining a first opening configured to allow an object in the cavity to exit therethrough, the front defining a second opening configured to allow an object outside of the container to move into the cavity of the container;

a handle extending from the container, wherein the handle defines a pathway configured to direct objects placed on the handle into the container; and a stirring mechanism rotatably mounted within the cavity of the container, wherein the stirring mechanism is configured to rotate within the cavity of the container and engage an object therein.

8. The push toy of claim 7, further comprising:

at least one wheel rotatably attached to the container.

9. The push toy of claim 7, further comprising:

a gathering mechanism operatively connected to the front of the container, the gathering mechanism being configured to direct an object outside of the container through the second opening and into the cavity.

10. The push toy of claim 9, wherein the gathering mechanism includes at least one paddle pivotally coupled to the container proximate to the second opening.

11. The push toy of claim 7, further comprising:

a speaker, configured to produce audio output in response to actuation.

12. The push toy of claim 11, wherein the speaker is configured to be actuated by rotation of the stirring mechanism.

13. A child's push toy, comprising:

a housing comprising:

an upper compartment including an outer wall and an inner wall, the inner wall and outer wall coupled at a top edge and the inner wall defining an interior cavity;

a lower compartment, the lower compartment attached to the upper compartment and having a top, bottom, front wall and back wall, the front wall including an opening for receiving objects therethrough;

a passageway, the passageway formed between the upper compartment and the lower compartment and configured to allow an object to move between the lower compartment and the upper compartment;

a collecting mechanism comprising at least one paddle pivotally coupled to the housing proximate the lower compartment, the at least one paddle being configured to direct an object outside of the housing through the passageway and into the interior cavity; and a stirring mechanism rotatably attached within the upper compartment, the stirring mechanism being configured to rotate within the interior cavity, and movement of the stirring mechanism causes objects to move.

14. The push toy of claim 13, further comprising:

at least one wheel; and an axle, wherein the at least one wheel is mounted on the axle, and the axle is rotatably attached to the container.

15. The push toy of claim 14, wherein the axle is configured to drive the stirring mechanism.

16. The push toy of claim 14, wherein the axle is configured to drive the collecting mechanism.

17. The push toy of claim 13, further comprising:

guide members coupled to the front wall and configured to direct objects toward the collecting mechanism.

18. The push toy of claim 13, wherein the passageway is configured to allow the at least one paddle to rotate through both the upper compartment and the lower compartment.

19. The push toy of claim 13, wherein the interior cavity has an open top, such that the stirring mechanism may cause objects to move above or outside of the top edge.

* * * * *

UNITED STATES PATENT AND TRADEMARK OFFICE

CERTIFICATE OF CORRECTION

PATENT NO. : 8,858,290 B2
APPLICATION NO. : 13/476408
DATED : October 14, 2014
INVENTOR(S) : Jacob J. Clark et al.

It is certified that error appears in the above-identified patent and that said Letters Patent is hereby corrected as shown below:

In the Specification

Column 1, line 35, change “stifling” to --stirring--;

Column 1, line 40, change “stifling” to --stirring--;

In the Claims

Column 7, line 46, (claim 1, line 7), after “one” delete “arm pivotally”;

Column 7, line 48, (claim 1, line 9), after “one” delete “arm”.

Signed and Sealed this
Third Day of March, 2015

Michelle K. Lee

Michelle K. Lee
*Deputy Director of the United States Patent and Trademark Office*